US009228575B2

(12) United States Patent
Oberkorn et al.

(10) Patent No.: US 9,228,575 B2
(45) Date of Patent: Jan. 5, 2016

(54) SEALED AND SELF-CONTAINED TANKLESS WATER HEATER FLUSHING SYSTEM

(75) Inventors: Deron B. Oberkorn, New Salisbury, IN (US); Gary L. Nichols, Louisville, KY (US); William L. Schmidt, Leitchfield, KY (US)

(73) Assignee: ZOELLER PUMP COMPANY, LLC, Louisville, KY (US)

( * ) Notice: Subject to any disclaimer, the term of this patent is extended or adjusted under 35 U.S.C. 154(b) by 1271 days.

(21) Appl. No.: 12/947,222

(22) Filed: Nov. 16, 2010

(65) Prior Publication Data

US 2012/0118246 A1 May 17, 2012

(51) Int. Cl.

| | |
|---|---|
| ***F24H 9/00*** | (2006.01) |
| ***B01D 29/15*** | (2006.01) |
| ***B01D 24/12*** | (2006.01) |
| ***C02F 9/00*** | (2006.01) |
| ***F04B 23/02*** | (2006.01) |
| *F24D 19/00* | (2006.01) |

(52) U.S. Cl.

CPC ..... *F04B 23/021* (2013.01); *F24D 19/0092* (2013.01)

(58) Field of Classification Search

None

See application file for complete search history.

(56) References Cited

U.S. PATENT DOCUMENTS

| | | | | | |
|---|---|---|---|---|---|
| 2,049,603 | A | * | 8/1936 | Dietenberger | 15/327.1 |
| 2,222,305 | A | * | 11/1940 | Tricomi et al. | 38/77.7 |
| 3,063,082 | A | * | 11/1962 | Rosenberg | 15/327.2 |
| 3,536,081 | A | * | 10/1970 | Riess | B08B 9/0323 134/103.1 |
| 3,645,420 | A | * | 2/1972 | Machado | B08B 3/3026 165/104.19 |
| 3,836,000 | A | * | 9/1974 | Jakubek | 210/104 |
| 3,879,264 | A | * | 4/1975 | Seelbach | 196/46.1 |
| 4,024,064 | A | * | 5/1977 | Rakowicz et al. | 210/258 |
| 4,312,646 | A | * | 1/1982 | Fattinger et al. | 96/239 |
| 4,684,462 | A | * | 8/1987 | Augustyniak | 210/97 |
| 4,813,383 | A | | 3/1989 | Daugirda | |
| 4,859,345 | A | * | 8/1989 | Inagaki | 210/764 |
| 4,880,652 | A | * | 11/1989 | Regutti | 426/417 |
| 4,905,900 | A | * | 3/1990 | Scharton et al. | 239/99 |
| 4,957,624 | A | * | 9/1990 | Peranio | 210/129 |
| 5,006,304 | A | * | 4/1991 | Franklin et al. | 376/316 |
| 5,019,329 | A | * | 5/1991 | Franklin et al. | 376/316 |
| 5,050,394 | A | * | 9/1991 | Dudley et al. | 62/115 |
| 5,156,747 | A | * | 10/1992 | Weber et al. | 210/744 |
| 5,350,505 | A | * | 9/1994 | Tang | 210/108 |
| 5,387,780 | A | * | 2/1995 | Riley | 219/688 |

(Continued)

OTHER PUBLICATIONS

Disclosure from PlumbersCrib.com website dated 2009.

(Continued)

*Primary Examiner* — Gregory Huson
*Assistant Examiner* — Eric Gorman
(74) *Attorney, Agent, or Firm* — Scott R. Cox

(57) ABSTRACT

A sealed and self-contained tankless water heater flushing system including a holding basin, a cover lid for the holding basin firmly securable and sealed liquid tight to the holding basin, a submersible pump contained within the holding basin, a submersible pump hose, securable from the submersible pump within the holding basin to a discharge opening in the cover of the holding basin, a filter system, securable within the holding basin to a filter opening contained in the cover lid, wherein the filter system includes a filter for filtering solid substances from the tankless water heater during a flushing process, a discharge hose for connecting the discharge opening to the water heater, and a filter hose for connecting the filter opening to the water heater.

13 Claims, 6 Drawing Sheets

(56) References Cited

U.S. PATENT DOCUMENTS

| | | | | |
|---|---|---|---|---|
| 5,406,934 | A * | 4/1995 | Cain | 126/117 |
| 5,417,851 | A * | 5/1995 | Yee | 210/167.01 |
| 5,449,453 | A * | 9/1995 | Tang | 210/108 |
| 5,458,788 | A * | 10/1995 | Tang | 210/744 |
| 5,490,611 | A * | 2/1996 | Bernosky et al. | 222/1 |
| 5,536,366 | A * | 7/1996 | Marcoccia et al. | 162/43 |
| 5,605,251 | A * | 2/1997 | Retti | 222/1 |
| 5,690,824 | A * | 11/1997 | Stuth | 210/333.01 |
| 5,758,820 | A * | 6/1998 | Celorier et al. | 237/2 B |
| 5,849,151 | A * | 12/1998 | Marcoccia et al. | 162/42 |
| 5,891,982 | A * | 4/1999 | Graham | 528/176 |
| 5,928,516 | A * | 7/1999 | Hopkins et al. | 210/636 |
| 5,983,886 | A * | 11/1999 | Allbeck | 126/271.2 B |
| 5,996,848 | A * | 12/1999 | Sperry et al. | 222/145.2 |
| 6,117,573 | A * | 9/2000 | Nishioka et al. | 428/698 |
| 6,123,858 | A * | 9/2000 | Manz | 210/744 |
| 6,170,493 | B1 * | 1/2001 | Sivacoe | 134/8 |
| 6,174,439 | B1 * | 1/2001 | Hopkins et al. | 210/493.1 |
| 6,280,300 | B1 * | 8/2001 | Komatsu et al. | 451/87 |
| 6,294,054 | B1 * | 9/2001 | Sutter | B01D 3/10 202/176 |
| 6,306,294 | B1 * | 10/2001 | Blair | 210/167.28 |
| 6,315,524 | B1 | 11/2001 | Muhs et al. | |
| 6,322,705 | B1 * | 11/2001 | Stornes | 210/669 |
| 6,341,612 | B1 * | 1/2002 | Duckett et al. | 134/95.1 |
| 6,368,497 | B1 * | 4/2002 | de Sylva | 210/120 |
| 6,391,121 | B1 * | 5/2002 | Sivacoe | 134/8 |
| 6,447,842 | B1 * | 9/2002 | Nishioka et al. | 427/249.15 |
| 6,550,487 | B1 * | 4/2003 | Duckett et al. | 134/22.18 |
| 6,562,145 | B2 * | 5/2003 | Duckett et al. | 134/27 |
| 6,585,492 | B2 | 7/2003 | Muhs et al. | |
| 6,632,352 | B2 * | 10/2003 | Holt | 210/184 |
| 6,755,207 | B1 * | 6/2004 | Curtis et al. | 137/205 |
| 6,770,150 | B1 * | 8/2004 | Duckett et al. | 134/29 |
| 6,875,959 | B1 * | 4/2005 | Ciejek | 219/430 |
| 6,926,016 | B1 * | 8/2005 | Zuck et al. | 134/84 |
| 7,109,453 | B1 * | 9/2006 | Nadolski | 219/688 |
| 7,267,235 | B2 * | 9/2007 | Sharir | 210/413 |
| 7,374,669 | B2 * | 5/2008 | Zinn | 210/138 |
| 7,506,386 | B1 * | 3/2009 | Adrian | 4/598 |
| 7,597,269 | B2 | 10/2009 | Nutsos | |
| 7,997,457 | B1 * | 8/2011 | Phillips et al. | 222/334 |
| 8,153,001 | B2 * | 4/2012 | Peters | 210/232 |
| 8,388,833 | B2 * | 3/2013 | Robertson et al. | 210/85 |
| 2001/0000893 | A1 * | 5/2001 | Hopkins et al. | 210/348 |
| 2002/0046965 | A1 * | 4/2002 | de Sylva | 210/175 |
| 2002/0060179 | A1 * | 5/2002 | Hopkins et al. | 210/244 |
| 2002/0096199 | A1 * | 7/2002 | Duckett et al. | 134/26 |
| 2003/0010694 | A1 * | 1/2003 | Holt | 210/184 |
| 2003/0085182 | A1 * | 5/2003 | Wilkins et al. | 210/767 |
| 2003/0085237 | A1 * | 5/2003 | Kateman et al. | 222/1 |
| 2003/0185548 | A1 * | 10/2003 | Novotny et al. | 392/314 |
| 2004/0045983 | A1 * | 3/2004 | McCann et al. | 222/146.6 |
| 2004/0149742 | A1 * | 8/2004 | Lescano | 219/688 |
| 2004/0244106 | A1 * | 12/2004 | Chesters | 4/620 |
| 2005/0011910 | A1 * | 1/2005 | McCann et al. | 222/146.6 |
| 2005/0056581 | A1 * | 3/2005 | Arguello | 210/258 |
| 2005/0104371 | A1 * | 5/2005 | Atkinson | 285/133.11 |
| 2005/0138753 | A1 * | 6/2005 | Hufnagel | F28G 1/02 15/316.1 |
| 2006/0027571 | A1 * | 2/2006 | Miyoshi et al. | 219/687 |
| 2006/0196251 | A1 | 9/2006 | Richey | |
| 2007/0007192 | A1 * | 1/2007 | Reid | 210/269 |
| 2007/0107789 | A1 * | 5/2007 | Reck | 137/887 |
| 2007/0169827 | A1 * | 7/2007 | Reck | 137/887 |
| 2008/0006576 | A1 * | 1/2008 | Suzuki et al. | 210/620 |
| 2008/0142104 | A1 * | 6/2008 | Reck | 137/887 |
| 2008/0277417 | A1 * | 11/2008 | Groesbeck | 222/105 |
| 2008/0283520 | A1 * | 11/2008 | Monteleone et al. | 219/688 |
| 2009/0020468 | A1 * | 1/2009 | Dannenmaier et al. | 210/232 |
| 2009/0205742 | A1 * | 8/2009 | Kuo | 141/2 |
| 2009/0222981 | A1 * | 9/2009 | Hartman | 4/313 |
| 2009/0236361 | A1 * | 9/2009 | Doelman et al. | 222/1 |
| 2010/0012590 | A1 * | 1/2010 | Slark | 210/664 |
| 2010/0065414 | A1 * | 3/2010 | Rautenbach et al. | 202/167 |
| 2010/0130627 | A1 * | 5/2010 | Casalini et al. | 521/59 |
| 2010/0139794 | A1 * | 6/2010 | Reck | 137/625.17 |
| 2010/0196835 | A1 * | 8/2010 | Burnett et al. | 432/1 |

OTHER PUBLICATIONS

Waiwela promotional brochure dated 2009.
Wisemans promotional brochure dated 2009.
Whitlam promotional brochure dated 2009.
Disclosure from Rinnai website dated 2009.

* cited by examiner

SEALED AND SELF-CONTAINED TANKLESS WATER HEATER FLUSHING SYSTEM

RELATED APPLICATION

None

FIELD OF THE INVENTION

One aspect of the invention relates to a sediment or scale flushing system for removal of deposits, such as scale or sediment, from a tankless water heater, which system can also be used with other equipment, such as heat exchangers, boilers, condensers, and other equipment, wherein scale and sediment build-up is a problem.

BACKGROUND OF THE INVENTION

This section is intended to introduce the reader to various aspects of art that may be related to various aspects or embodiments of the present invention, which are described and/or claimed below. This discussion is believed to be helpful in providing the reader with background information to facilitate a better understanding of the various aspects and embodiments of the present invention. Accordingly, it should be understood that these statements are to be read in light of, and not as admissions of prior art.

Tankless water heaters, also called instantaneous or demand water heaters, provide hot water, as needed. Traditional storage water heaters experience standby energy losses that can be both expensive and time consuming because they are required to maintain a predetermined volume of hot water. Tankless water heaters only produce hot water when there is a demand. In operation, when a hot water tap of such heaters is turned on, cold water travels through a pipe into the tankless water heater. In an electric tankless water heater, an electric element heats the water directly. In a gas-fired tankless water heater, a gas burner is lit which heats the water. Tankless water heaters deliver a constant supply of hot water and do not require a storage tank for previously heated water. Tankless water heaters can be used in a number of situations that demand an instantaneous supply of hot water, including use with certain appliances, such as clothes washers or dish washers, and in other situations such as in kitchens, outdoor sinks, remote bathrooms or hot tubs.

One problem that has occurred with these tankless water heaters, especially in areas with hard water, is that minerals present within the water solidify and adhere to the sides of the piping, particularly copper piping, that is utilized within these tankless water heaters. These minerals, commonly calcium carbonate, condense within the piping of the tankless water heater, gradually reducing the flow of the water through the piping and thereby interfere with the normal operation of the tankless water heater. The result is an inefficient tankless water heating system and, if a large amount of buildup occurs, permanent damage to the tankless water heater system.

Currently, the piping of tankless water heater systems is cleaned utilizing open, flushing systems, wherein a solution of an acid, such as vinegar in water, is poured into an open bucket and is then pumped through the tankless water heater system for a sufficient period of time to remove the scale or other deposits from the piping. Unfortunately, many of these scale removal systems are cumbersome, difficult to use, subject to spills and create significant odor and irritation when used, especially indoors, because of the vapors generated by the acidic material. Further, these open scale removal systems can be troublesome and time consuming to use and require repeated use to remove substantially all of the sediment or scale.

These open scale removal systems also create significant risks to users, bystanders, and to the environment in which they are used. The system design of these prior art systems offers no protection against spills, splashing, or vapors given off by the acidic material. In addition, this acidic material can cause injury to the operator or bystanders, such as chemical burns to the skin, eyes, or lungs through inhalation. Also, spilled material poses a slip-and-fall hazard and can damage property, such as carpet, wood or vinyl flooring.

Prior art open scale removal systems also create a difficult storage challenge for end users. When not in use, the discharge hose of such system is often left secured to the pump to reduce the time required to hook up or unhook the system. The return hose is often placed loosely with the pump, usually in a bucket. The power cord is often wrapped around the pump and also placed in the bucket with the other hose. These systems give the end user few options for safe system storage without risking damage to the hoses, power cord, pump or the surrounding environment.

It is therefore one object to produce a sealed, preassembled, and self-contained recirculating system to remove scale and other sediment from tankless water heater systems without the problems of previous open systems.

It is a further object to produce a sealed, preassembled self-contained recirculating system for cleaning tankless water heater systems, which reduces the presence of unpleasant odors and the opportunity for the acidic liquid to spill during use.

It is a further object to provide a sealed, preassembled self-contained recirculating system for cleaning tankless water heater systems which can be monitored visually while in operation without opening the system.

It is a further object to provide a sealed, preassembled self-contained recirculating system for cleaning a tankless water heater system which can be reused, regardless of the quantity of scale and other sediments that are present in the tankless water heater system being cleaned.

It is a further object to provide a sealed, preassembled self-contained system for cleaning a tankless water heater system utilizing a filter to remove the scale and other sediment, which filter can be removed, cleaned and reused.

It is a further object to provide a sealed, preassembled self-contained system for cleaning a tankless water heater system with serviceable access connections in a holding basin and a cover lid for the purpose of filling and emptying an acidic solution without having to disassemble the tankless water heater flushing system.

It is a further object to provide a sealed, preassembled self-contained system for cleaning a tankless water heater system that is easy and safe for the end user to store and secure the hoses and power cord when not in use.

To accomplish these and other objects, a sealed and self-contained tankless water heater flushing system is provided comprising a holding basin, a cover lid for the holding basin secured to the holding basin, a submersible pump contained within the holding basin, a submersible pump hose system secured from the submersible pump to a discharge opening in the cover lid of the holding basin, a filter system secured within the holding basin to a filter opening in the cover of the holding basin, which filter system is an integral component of the flushing system, wherein the filter system includes a filter for filtering solid substances, such as scale or sediment, from the tankless water heater during a flushing procedure, a discharge hose for connecting the discharge opening to the tankless water heater, a filter hose for connecting the filter opening to the tankless water heater, serviceable access connections in the holding basin and cover lid for filling and emptying the system, and handles that can be used to conveniently store and secure the discharge hose, filter hose, and power cord when not in use.

SUMMARY OF THE INVENTION

A sealed and self-contained tankless water heater flushing system comprising a holding basin, a cover lid for the holding basin, firmly securable to the holding basin, serviceable access connections in the holding basin and cover lid, a submersible pump, contained or secured within the holding basin, a system securable from the submersible pump to a discharge opening in the cover lid of the holding basin, a filter system, secured within the holding basin to a filter opening in the cover lid of the holding basin, which filter system is an integral component of the flushing system, wherein the filter system comprises a filter for filtering solid substances from the tankless water heater during the flushing process, wherein the filter is removable for cleaning, a discharge hose for connecting the discharge opening to the tankless water heater, a filter hose for connecting the filter opening to the tankless water heater, and carry handles for providing a means for hose and power cord storage.

DETAILED DESCRIPTION OF THE INVENTION

Figure 1:
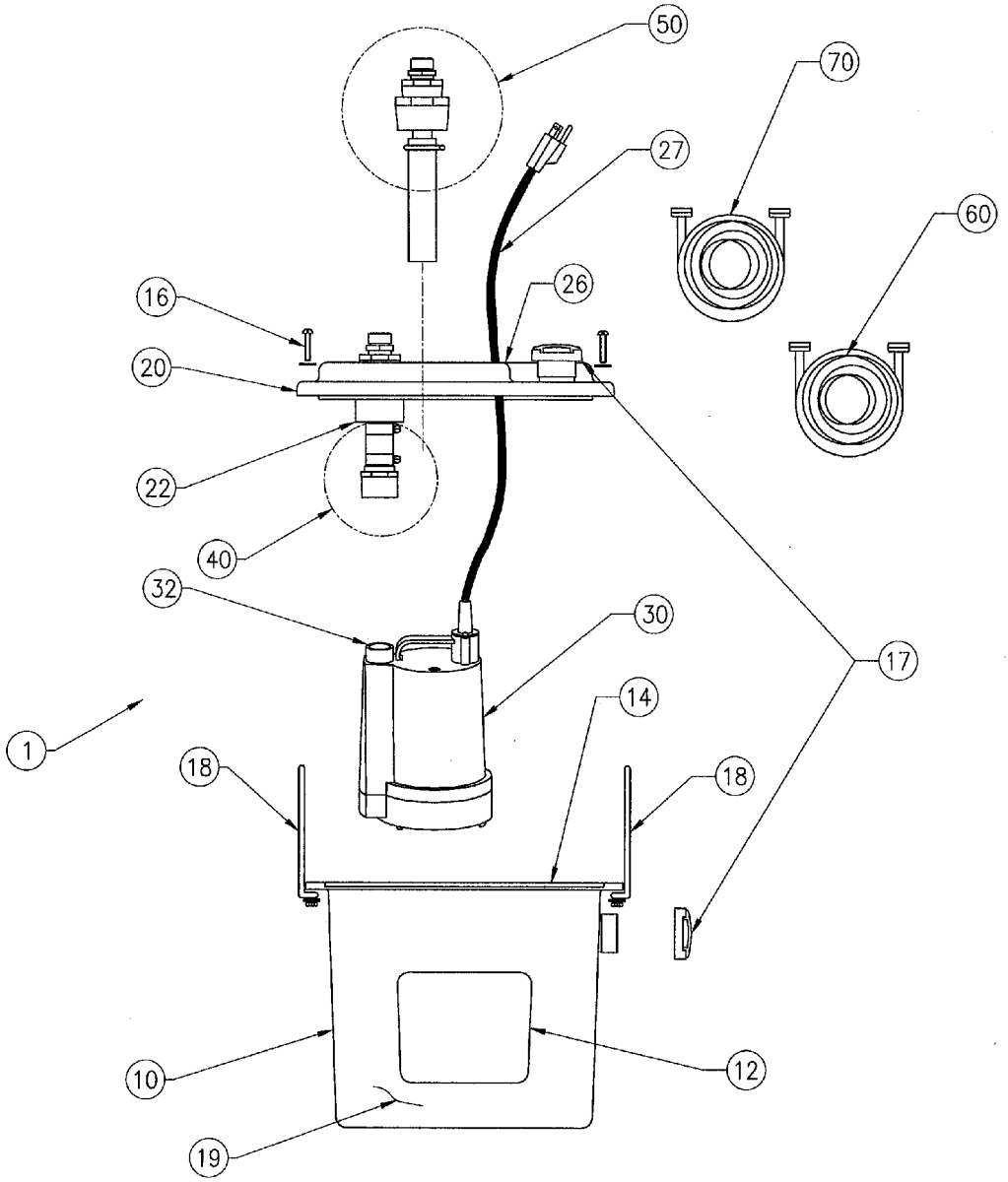
FIG. 1 is a side perspective, exploded view of the tankless water heater flushing system.

The sealed and self-contained tankless water heater flushing system (1), disclosed in FIGS. 1-6, includes a holding basin (10), a cover lid (20) firmly securable to the holding basin, a submersible pump (30) contained and/or secured within the holding basin, a submersible pump hose system (40) securable from the submersible pump to or through a discharge opening (22) in the cover lid of the holding basin, a filter system (50) securable to the holding basin to or through a filter opening (24) in the cover lid of the holding basin, which filter system is an integral component of the flushing system (1), wherein the filter system includes a filter (52) for filtering solid substances, such as sediment or scale, from the tankless water heater (90) during a flushing process, a discharge hose (60) for connecting the discharge opening (22), and indirectly connecting the submersible pump hose system, to the tankless water heater, a filter hose (70) for connecting the filter opening, and indirectly connecting the filter system to the tankless water heater, and carry handles (18) for carrying the flushing system and also for hose and power cord (27) storage.

In one embodiment, the holding basin (10) of the flushing system (1) is a generally bucket-shaped container, which has a capacity to hold a substantial quantity of liquids, preferably from about at least 1 gallon up to about 10 gallons or so. The holding basin is preferably made of a pliable product that is resistant to acids, particularly mild acids, such as vinegar or other mild acidic solutions. In one preferred embodiment the holding basin is made of an HDPE polymer, which is resistant to acids and can withstand intermittent temperatures of those acidic solutions up to at least 110° F. (43° C.) or so.

In one preferred embodiment, the holding basin and/or cover lid further contains access connection with a removable sealing cover (17). This access connection can be used to empty the basin after use or to fill the basin before use.

In one embodiment, there is incorporated into at least one portion of a side of the holding basin a transparent or generally transparent viewing window (12). In a preferred embodiment, an individual looking through the viewing window (12) of the holding basin can see the interior of the holding basin and the equipment, filter, piping and liquids that are present therein. The size or shape of this viewing window is not critical but should be at least about 6 inches square or so. In addition, the composition of this viewing window should also be resistant to acids and heat in a manner similar to the holding basin. If desired, this viewing window can be removable from the holding basin for cleaning. As an alternative, the entire holding basin can be transparent, if desired.

In another embodiment, a generally transparent polymeric return fitting (50) can be used to view the condition of the returned liquid mixture and monitor for excessive scale and sediment before the filter element (52) becomes clogged. (See FIG. 2). The return fitting can be entirely or partially transparent, depending on the desired method of construction.

Securable to a top lip (14) of the holding basin (10) is the cover lid (20). Said cover lid should be firmly securable to the holding basin, although it should also be capable of removal to access the interior of the holding basin. The cover lid can be firmly secured to the holding basin by conventional means, such as screws (16) or bolts passing through the cover lid and into the holding basin, or by clips which secure the cover lid to the holding basin. Preferably, the cover lid (20) and/or top lip (14) design should also include sealing agents, such as o-rings, gaskets, or other mechanical seals, to prevent vapors from escaping the holding basin (10). The cover lid (20) should be made of the same or similar acid and heat resistant material as is the holding basin, for example an HDPE polymer.

Figure 6:
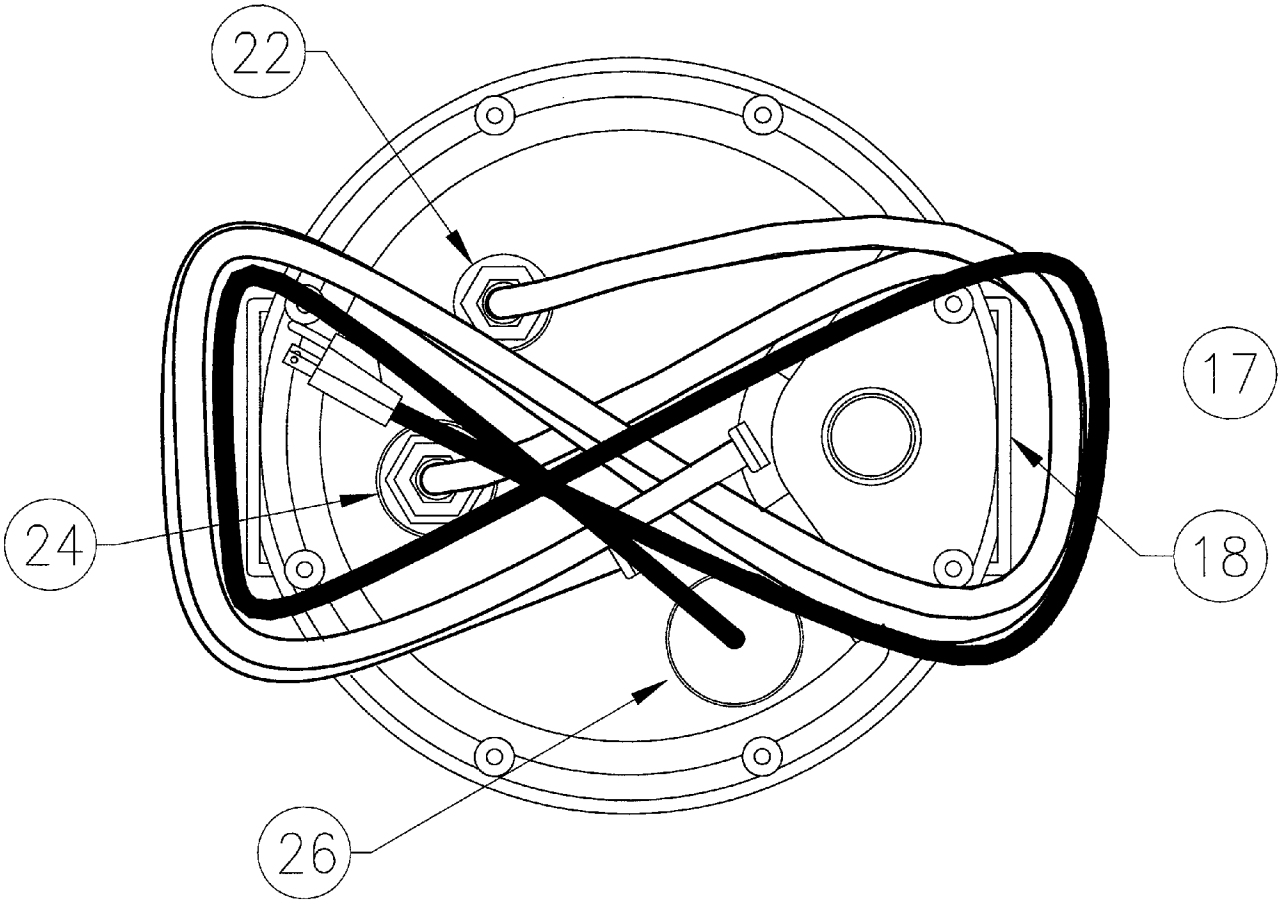
FIG. 6 is a top view of the cover lid secured to the holding basin showing hoses and a power cord of the flushing system stored using carry handles of the holding basin.

There is preferably secured to the cover lid (20) or the top lip (14) of the holding basin (10) carry handles (18) for lifting the flushing system (1). In one embodiment, the handles are three sided with perpendicular corners in a "C" shape, secured to the cover lid (20), and located on opposite sides of the holding basin when the cover lid is installed, as shown in FIG. 1. In addition to the use of the handles to lift the flushing system, they should also be securable to the system (1) in a vertical position for use to store the power cord (27), discharge hose (60) and the filter hose (70) when not in use, as will be discussed later and as shown in FIG. 6.

Contained within the holding basin is a removable, submersible pump (30). The submersible pump can be a conventional, submersible pump with a capacity of flow of approximately 1 to 3 gallons or so per minute and should be able to draw down to about one-fourth of an inch or less of depth within the holding basin (10). In one embodiment, the pump is air filled with no oil present within the motor housing and the motor is a 115/230 volt, 50/60 Hz and thermally overload protected and approved. The pump should be tested to 130° F. for three hours of continuous operation. One example of such a pump is a 42-0009 pump, manufactured by Zoeller Co. The submersible pump is preferably seated in a bottom portion (19) in the holding basin and held in position by gravity. Alternatively, it may be permanently secured to the bottom portion of the holding basin by conventional securing means. In a further alternative embodiment, legs of the submersible pump fit within open receptacles formed as a component of the bottom portion of the holding basin (not shown). Alternatively, the pump can be held in place within the holding basin (10) by the interaction of components of the system secured to the cover lid, such as the pump hose system (40), and the pump itself.

Securable to the submersible pump (30), is the submersible pump hose system (40). (See FIG. 3) The submersible pump hose system (40) is securable between the submersible pump (30) and the discharge opening (22) in the cover lid (20) of the holding basin. The specific components of this submersible pump hose system (40) can be varied, but generally include a fitting (42) that secures to a discharge opening (32) in the submersible pump, various couplings and other conventional components, such as hoses, that attach to and provide passage for a liquid to flow through the discharge opening (22) in the cover lid (20) of the flushing system (1). For example, in one embodiment, the submersible pump hose system (40) is comprised of a fitting (42) attached to the pump discharge (32), a rigid connection at the discharge opening (22), and a flexible length of hose (44) between the two connections, secured in a manner that allows for easy servicing of the pump (30) and pump hose system (40), such as by a snap ring, hose clamp, or similar fastening device (46). An integral part of the submersible pump hose system (40) on the outside of the cover lid is a fitting (43) for attachment to the discharge hose (60). Fitting (43) is connected to, or an integral part of, a larger fitting (45) that assembles into the cover lid (20) so that vapors from within the holding basin (10) do not escape the holding basin. A pipe stub extends from the larger fitting (45) to attach to the flexible length of hose (44). The larger fitting (45) is secured to the cover lid (20) by means of threads, rotational locking features, or other clamping or sealing devices to provide a gas-tight seal.

Figure 4:
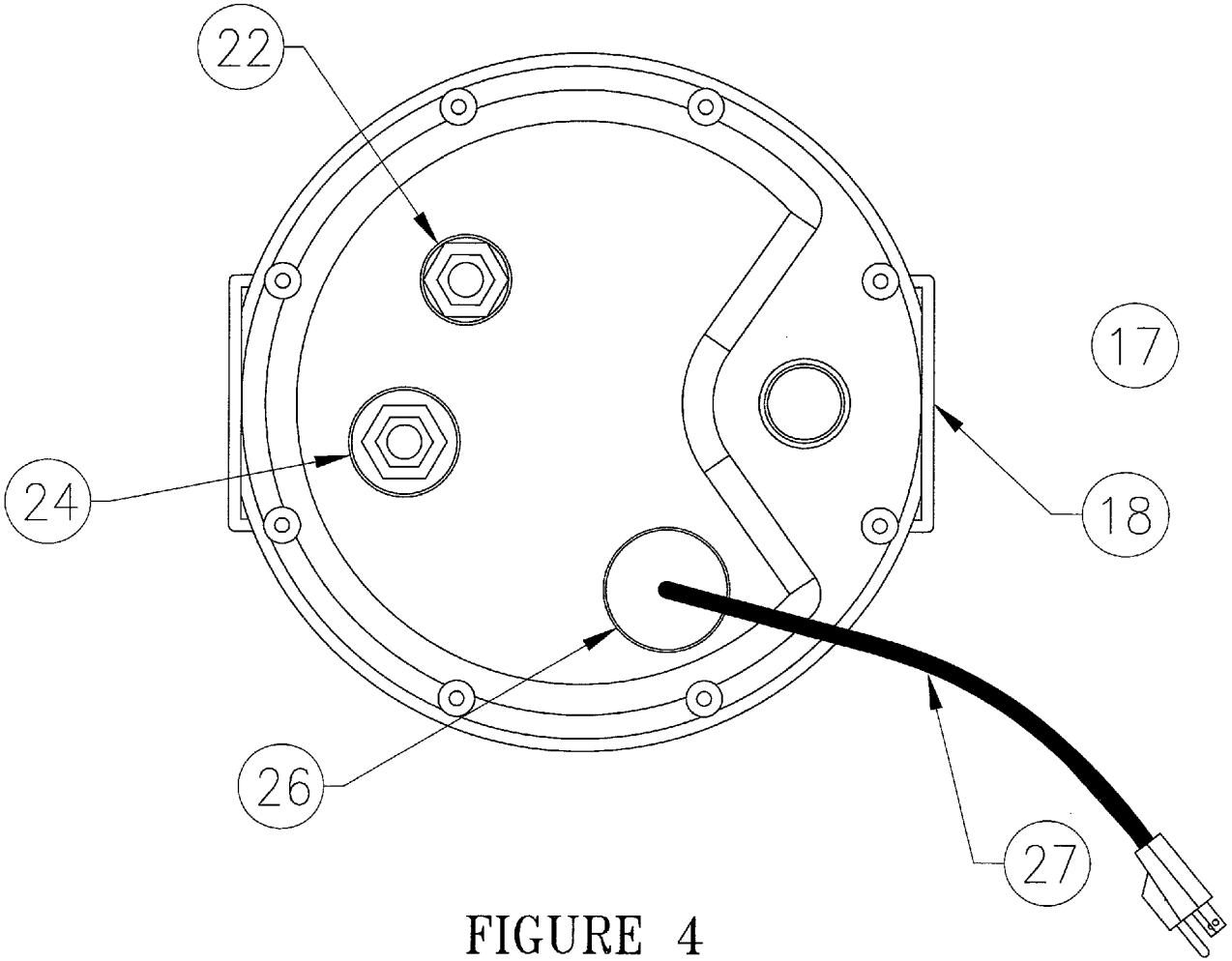
FIG. 4 is a top view of the cover lid that is secured to the holding basin.

An electrical line cord seal (26) is also provided in the cover lid (20) to permit the power cord (27) from the submersible pump (30) to pass from the submersible pump through the cover lid (20) for attachment into a conventional electrical outlet (See FIGS. 1 and 4). The cord seal (26) in the cover lid (20) for this power cord (27) should be tight fitting around the power cord (27) so that odor from within the holding basin does not escape.

A third opening in the cover lid is the filter opening (24). (See FIG. 4). The filter opening receives the filter system (50) which is secured within the holding basin (10) for connection to the filter opening (24), which filter system is an integral component of the flushing system. The filter opening may be a threaded connection, rotational locking connection, or use other clamping and sealing design, but preferably uses a design whereby the filter system (50) can be easily removed from the holding basin. The filter opening design may also include sealing agents, such as o-rings, gaskets, or other mechanical seals, to prevent vapors from escaping the holding basin (10).

Figure 2:
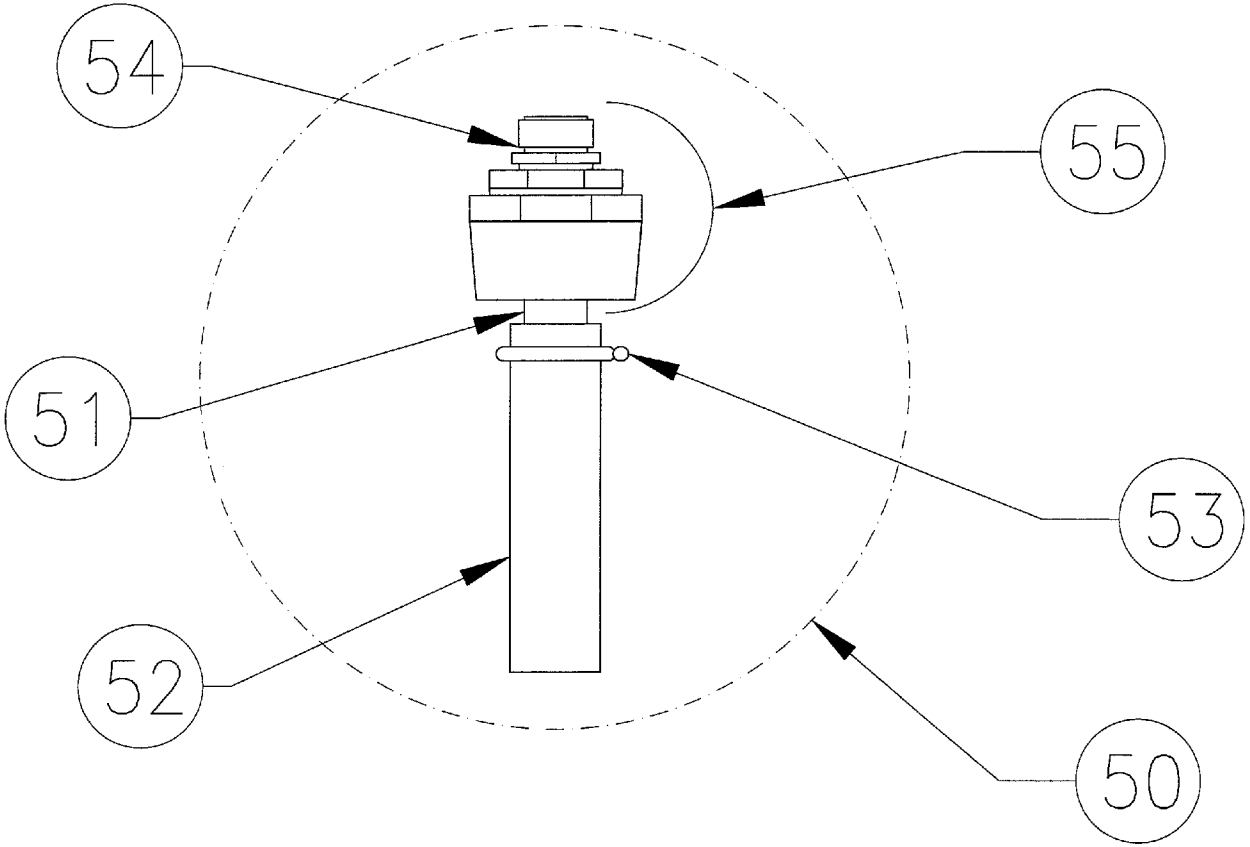
FIG. 2 is a side view of the filter system, which is an element of the flushing system, and is secured to the holding basin of the flushing system.
Figure 3:
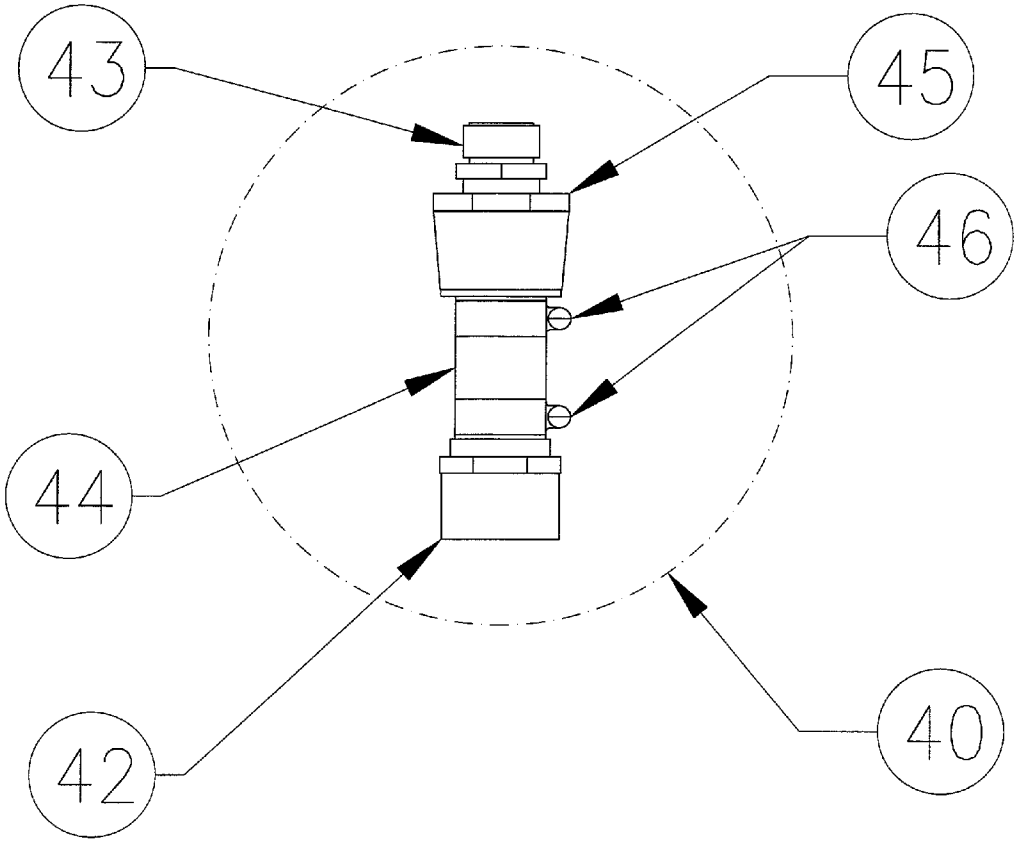
FIG. 3 is a side view of the submersible pump hose system, secured to the holding basin from the submersible pump to a discharge opening in a cover lid of the holding basin.

The filter system (50) includes at least the filter (52) for filtering solid substances, such as scale or sediment, from the tankless water heater (90) during a flushing process. The filter system is secured to the filter opening (24) in the cover lid (20), as previously discussed, and includes hose adaptors, piping and other elements as shown in FIG. 2. In one embodiment, the filter (52) attaches to a fitting assembly (55) that is made up of a plurality of fittings or it can be fabricated as a single piece. This fitting assembly (55) includes a filter tube (51) and return hose adapter (54). The fitting assembly (55) can be made of a generally transparent material so that the condition of the fluid from the tankless water heater can be monitored as the system operates.

Figure 5:
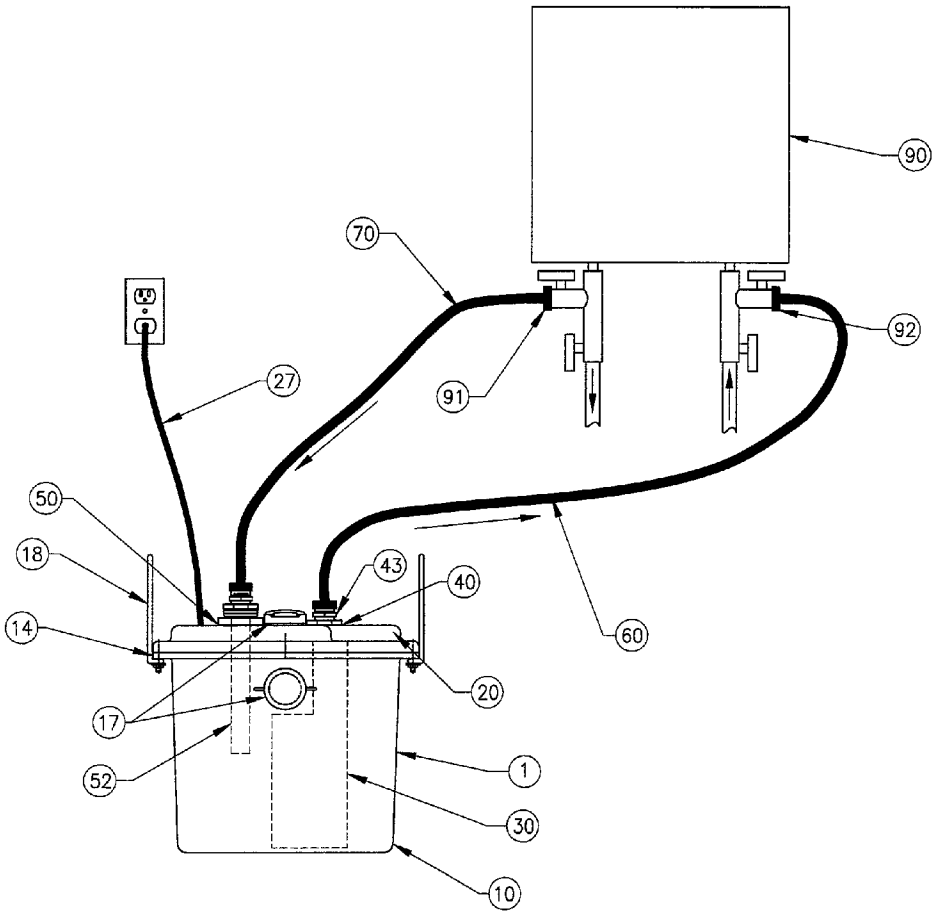
FIG. 5 is a side view of the water heater flushing system secured to a tankless water heater.

An integral component of the filter system (50) is the filter (52), which is preferably secured on or near the end of the filter system (50) within the holding basin (10), as shown in FIG. 5. The filter can be formed of several different types of material, as long as it removes sediment or scale down to a small size, such as about 200 microns or so, from the liquid that is being flushed through the tankless water heater. In one embodiment, the filter comprises a flexible mesh filter permitting filtration to about 200 microns, which is secured onto the end of a filter tube (51) of the filter system (50). (See FIG. 2) In one embodiment, the filter (52) is secured to the filter tube (51) in such a way as to be easily removable for quick disconnection, such as by a snap ring, hose clamp, or similar fastening device (53). The filter securing design allows for the filter to be removed and cleaned or replaced. In addition, the filter should be corrosion resistant to the acid solution normally used with the system and to elevated temperatures up to about 130° F. (54° C.) or so. The filter prevents flushed solid materials, such as sediment or scale, from entering the submersible pump and thereby reduces abrasion of the shaft, seals and rotating parts of the submersible pump.

In one preferred embodiment, if the filter (52) becomes full, or substantially full, of sediment or scale, the filter (52) construction and design allows for the acidic liquid to pass through the packed filter without failing the filter or causing damage to the submersible pump (30).

Securable to the discharge opening (22) is the discharge hose (60) and to the filter opening (24) is the filter hose (70). (See FIG. 5) These may be approximately the same size, shape and configuration and comprise conventional hosing, each with two adaptors, one for attachment to the discharge opening (22) or filter opening (24) and the other adaptor for attachment to the tankless water heater (90).

In operation, one end of each of the discharge hose (60) and the filter hose (70) is connected to the tankless water heater inlet and outlet openings. (91, 92) (See FIG. 5.) Contained within the holding basin (10) is an acidic system, such as vinegar or other approved cleaning solution. The submersible pump (30) contained within the holding basin (10) is activated to pump the solution through the submersible pump hose system (40) into the discharge hose (60) for passage through the tankless water heater (90). After passage through the water heater, the solution, containing sediment and/or scale from the tankless water heater, is discharged from the tankless water heater and flows through the filter hose (70) into the filter system (50), where it is filtered by the filter (52). Liquid, from which the sediment or scale has been filtered, is then deposited into the holding basin (10) and recirculated by the submersible pump through the tankless hot water system (1). The tankless water heater flushing system is allowed to operate for a period of time sufficient to clean the tankless water heater. Following cleaning, the submersible pump is deactivated, the filter hose (70) and discharge hose (60) are disconnected from the tankless water heater and may be wrapped around the handles (18) of the flushing system for storage, as shown in FIG. 6. The power cord (27) can also be wrapped around the handles (18) for storage in the same manner as the hoses (60, 70). If necessary, the filter (52) can be removed from the filter system (50), cleaned or replaced.

While the present disclosure has been described by references to specific embodiments, it will be apparent that other alternative embodiments and methods of implementation or modification may be employed without departing from the scope of the disclosure.

The invention claimed is:

1. A sealed and self-contained tankless water heater flushing system comprising a holding basin, a cover lid for the holding basin, securable to the holding basin, a submersible pump, contained within the holding basin for pumping an acidic solution through the sealed and self-contained tankless water heater flushing system, a submersible pump hose, secured from the submersible pump to a discharge opening in the cover lid of the holding basin, a filter system, secured within the holding basin to a filter opening in the cover lid of the holding basin, wherein the filter system comprises a filter for filtering solid substances from the sealed and self-contained tankless water heater flushing system during a flushing process, and a fitting and tubing system secured to the filter opening of the holding basin and to the filter, a discharge hose, for connecting the discharge opening to the sealed and self-contained tankless water heater flushing system, and a filter hose, for connecting the filter opening to the sealed and self-contained tankless water heater flushing system.

2. The tankless water heater flushing system of claim 1, wherein the filter of the filter system is secured to the fitting and tubing system by a quick disconnect device.

3. The tankless water heater flushing system of claim 2, wherein the quick disconnect device is selected from the group consisting of a snap ring, hose clamp, or other securing systems for securing the filter to the fitting and tubing system.

4. The tankless water heater flushing system of claim 1, wherein the filter comprises a flexible mesh filter with filtration capability down to 200 microns.

5. The tankless water heater flushing system of claim 1, wherein the filter is removable from the flushing system for cleaning or replacement.

6. The tankless water heater flushing system of claim 1, wherein the filter system permits returned liquid to bypass the filter and return to the holding basin without damage to the filter or submersible pump, even if the filter is full of solid substances.

7. The tankless water heater flushing system of claim 1, further comprising a handle secured to the cover lid, with at least a portion of the handle located above the cover lid.

8. The tankless water heater flushing system of claim 7, wherein the handle is used for storage of the discharge hose, the filter hose and a power cord.

9. The tankless water heater flushing system of claim 1, wherein the holding basin further comprises a transparent or substantially transparent window in a portion of the holding basin.

10. The tankless water heater flushing system of claim 1, wherein the holding basin and the cover lid are manufactured of materials which are corrosion resistant to acidic liquids.

11. The tankless water heater flushing system of claim 1, wherein the cover lid is sealed to the holding basin prior to a flushing process to limit the discharge of a gas or a liquid spill from within the holding basin.

12. The tankless water heater flushing system of claim 1, wherein the submersible pump is tested to operate at temperatures of at least 130° F. for at least three hours under continuous operation with a flow rate of at least two gallons per minute.

13. The tankless water heater flushing system of claim 1, wherein the holding basin and cover lid contain an access connection to add liquids to and remove liquids from the holding basin.

* * * * *